United States Patent [19]

Solie et al.

[11] Patent Number: 4,471,805

[45] Date of Patent: Sep. 18, 1984

[54] CONTROL VALVE

[75] Inventors: James C. Solie; James I. Masterman, both of Owatonna; Michael T. Landrum, Medford; Larry D. Allard, Owatonna, all of Minn.

[73] Assignee: Owatonna Tool Company, Owatonna, Minn.

[21] Appl. No.: 320,592

[22] Filed: Nov. 12, 1981

[51] Int. Cl.[3] ..... F15B 13/04

[52] U.S. Cl. ..... 137/596.12; 137/625.21; 91/32; 91/451

[58] Field of Search ..... 91/470, 454, 456, 451, 91/32, 447; 137/625.21, 625.47, 596.12, 625.25, 625.23, 625.43; 251/304, 310, 311, 283

[56] References Cited

U.S. PATENT DOCUMENTS

| | | | |
|---|---|---|---|
| 2,360,987 | 10/1944 | Temple | 277/24 |
| 2,696,219 | 12/1954 | Barksdale | 137/625.43 |
| 2,892,450 | 6/1959 | Hogan | 121/46.5 |
| 3,165,119 | 1/1965 | Hewitt | 137/625.43 |
| 3,217,731 | 11/1965 | Swanson | 137/116.3 |
| 3,530,893 | 9/1970 | Masuda | 137/625.21 |
| 3,556,151 | 1/1971 | Masuda | 137/625.21 |
| 3,796,232 | 3/1974 | Dalton | 137/625.21 |
| 3,827,336 | 8/1974 | Caywood | 91/447 |
| 4,049,019 | 9/1977 | McClocklin | 137/625.21 |

FOREIGN PATENT DOCUMENTS

| | | | |
|---|---|---|---|
| 691697 | 5/1953 | United Kingdom | 137/625.23 |

OTHER PUBLICATIONS

Page identified as Industrial Hydraulic Division, (Parker logo), Fluidpower VC-119.

*Primary Examiner*—William R. Cline
*Assistant Examiner*—Peggy A. Neils
*Attorney, Agent, or Firm*—Wood, Dalton, Phillips, Mason & Rowe

[57] ABSTRACT

A control valve for controlling the flow of fluid to and from a single-acting cylinder and having a metered flow-controlling valve section and a rotatable valve member movable to four different positions to provide four different operations of the single-acting cylinder, namely: rapid advance, slow metered advance, hold and return.

11 Claims, 14 Drawing Figures

CONTROL VALVE

BACKGROUND OF THE INVENTION

This invention pertains to a control valve providing rapid advance, slow metered advance, hold and return action for a single-acting cylinder wherein all of the operations are under the control of a single handle connected to a rotatable valve member and wherein there is no pressure loss in the motor when the valve is shifted between rapid advance, metered advance and hold positions (non-interflow).

Three-position rotary control valves providing for plural operations of a motor are well known in the art, as seen in McClocklin U.S. Pat. Nos. 3,892,259 and Re. 30,517.

A rotary directional control valve having a valve member which coacts with four ports is shown in Schultz U.S. Pat. No. 3,677,295.

In certain types of test equipment, the normal testing cycle requires conventional advance, return and hold operations of a linear motor as well as a slow metered advance, with a carefully controlled rate of movement of the motor being controlled by the valve. A prior art commercial control used in such equipment has a flow control valve unit generally of the type shown in Swanson U.S. Pat. No. 3,217,731 wherein a handle associated with the flow control valve unit can be positoned to provide for either rapid advance or metered advance of the motor. In the commercial control, a second valve structure operable by a second handle is added into the hydraulic circuit and the second handle is positioned to provide for either advance operation, hold operation or return operation. It is not possible to obtain all of the four desired modes of operation by control of four valve positions by a single handle.

SUMMARY OF THE INVENTION

A primary feature of the invention disclosed herein is to provide a control valve having a single handle positionable to provide for four different operations of a linear motor controlled by the valve, namely, rapid advance, slow metered advance, hold and return. Additional features of the invention relate to fast return of a single-acting cylinder, increased uniformity of the rate of motor advance during the slow metered advance mode of operation, and prevention of flow between the valve and motor as the valve is shifted between advance, metered advance and hold positions.

A primary object of the invention is to provide a control valve and, particularly, a rotary control valve having a structure providing the features set forth above.

Another object of the invention is to provide a rotary control valve for controlling a single-acting cylinder in a fluid system having high pressures of up to 10,000 psi wherein a valve member has four different positions under the control of a control handle and, in a first position, directs pressure fluid directly to the single-acting cylinder; in a second position, directs pressure fluid to the single-acting cylinder, with the fluid being subject to pressure-compensated flow control action; in a third position, connects the single-acting cylinder to tank for return operation thereof; and, in a fourth position, blocks the outlet connection of the valve connectable to the cylinder and directs pressure fluid to tank to perform a hold operation.

Still another object of the invention is to provide a flow control valve spool movable within a bore and having an external annular groove connected through the interior of the spool to supply pressure to provide a fluid seal between the spool and the bore at a higher pressure than the pressure of fluid at the pressure-sensing end of the spool whereby fluid cannot leak to a tank passage from the pressure-sensing end of the spool.

Still another object of the invention is to provide a four-position rotary control valve comprising: a body having a pressure port, a tank port and an outlet port connectable to a single-acting cylinder; a valve member rotatable relative to and spaced from a face of the body; four control ports in said body opening to said body face and each having a seat seal extending from the body face and engageable against a face of the valve member; a pressure-compensated flow control associated with said body including an adjustable orifice device and a flow control spool; first passage means in said body extending to a first of said control ports, the upstream end of the adjustable orifice device and the pressure-regulating end of the flow control spool; second passage means in said body extending between a second of the control ports, the outlet port and the pressure-sensing end of the flow control spool; third passage means in said body extending between a third of said control ports and the downstream end of the adjustable orifice device; fourth passage means in said body extending between a fourth of the control ports and said outlet port; a check valve operable to prevent flow from the motor to said second control port through said second passage means; and said valve member having means for interconnecting said first and second control ports for rapid advance operation in a first position of the valve member, for interconnecting said second and third control ports for subjecting fluid to a pressure-compensated flow control action for metered advance operation in a second position, for interconnecting said first and fourth control ports to the tank port for a return operation in a third position, and for connecting said first control port to the tank port and blocking said fourth control port in a fourth position.

DESCRIPTION OF THE PREFERRED EMBODIMENT

Figure 1:
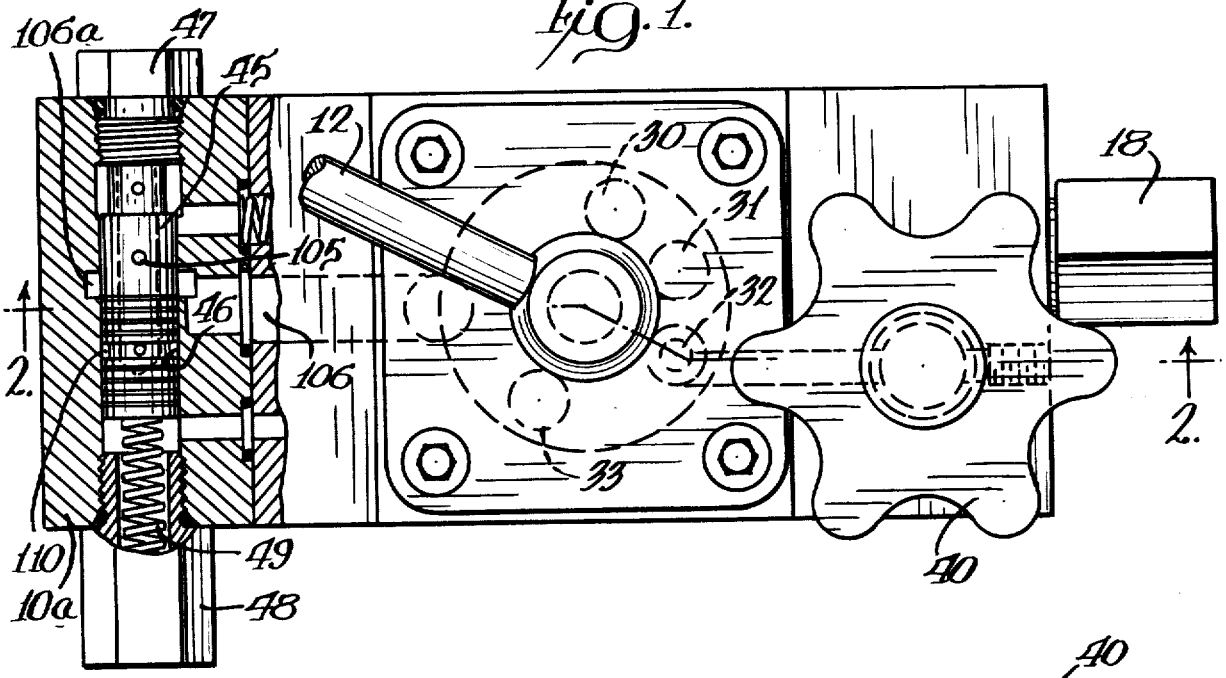
FIG. 1 is a plan view of the control valve with parts broken away to show the flow control spool and associated structure of the flow control.
Figure 2:
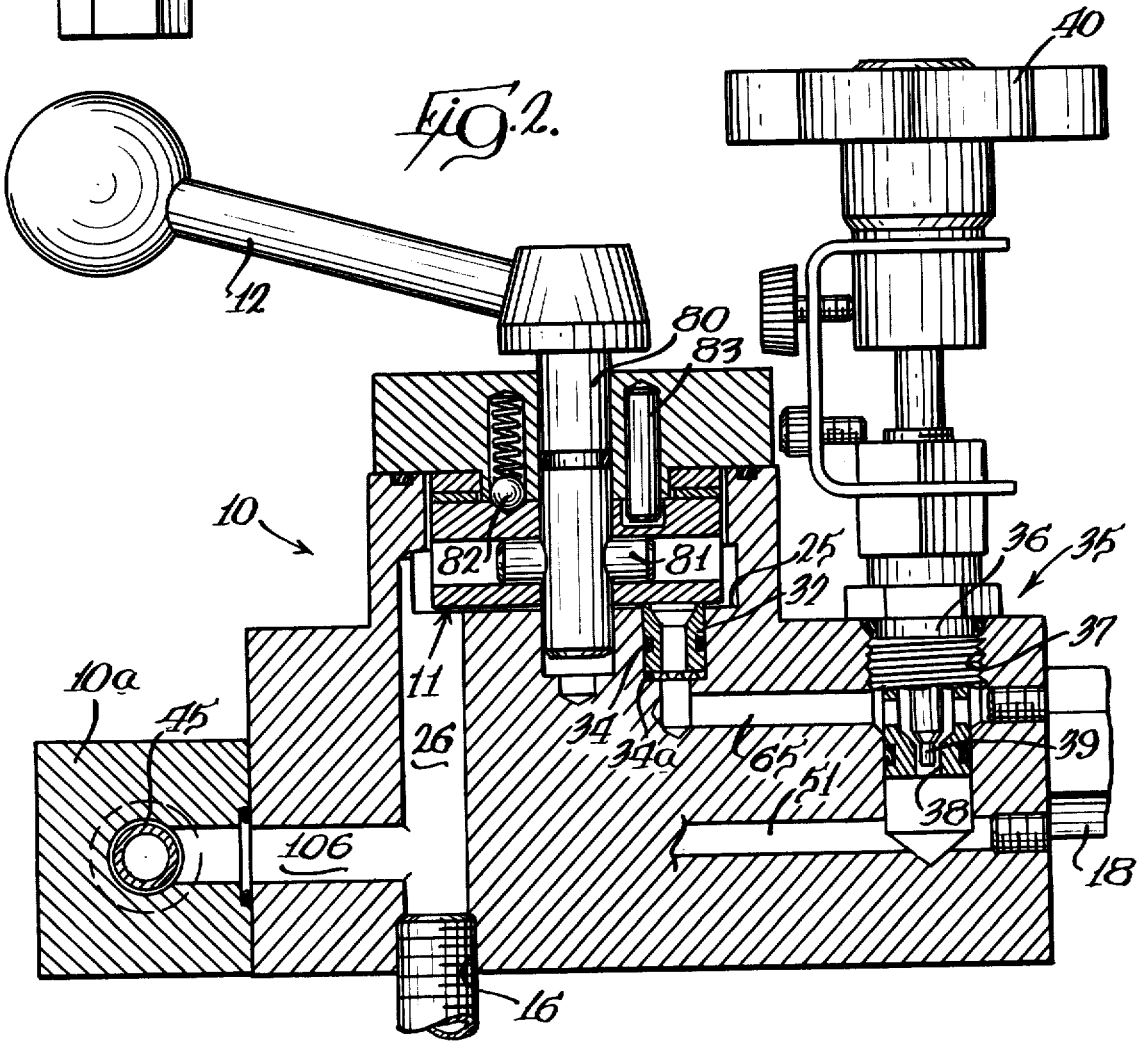
FIG. 2 is a vertical section, taken generally along the line 2—2 in FIG. 1.

The control valve is shown generally in FIGS. 1 and 2 and has a valve body, indicated generally at 10, which rotatably mounts a valve member, indicated generally at 11, which can be positioned in a selected one of four different positions by a control handle 12 operatively connected to the valve member.

Figure 7:
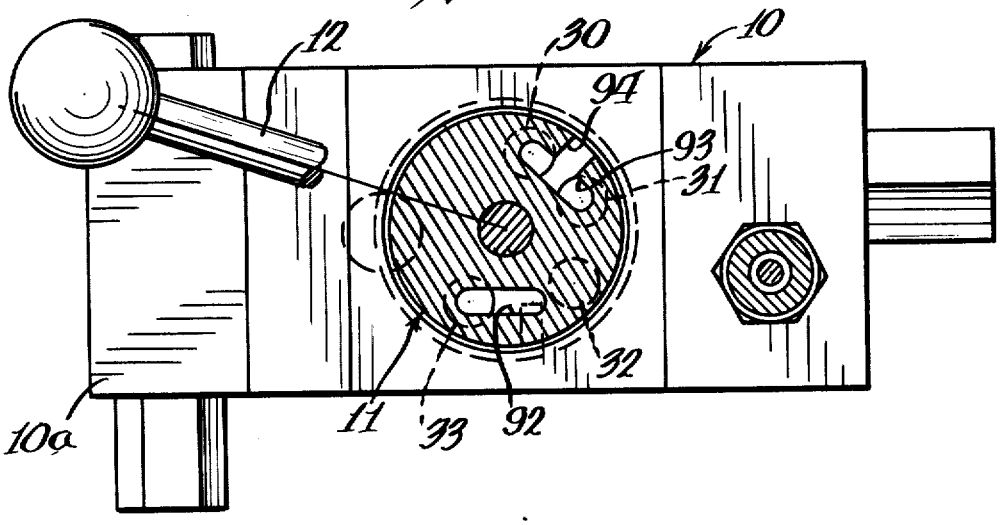
FIG. 7 is a plan view with parts broken away and the valve member of the control valve shown in section and positioned for return operation.
Figure 8:
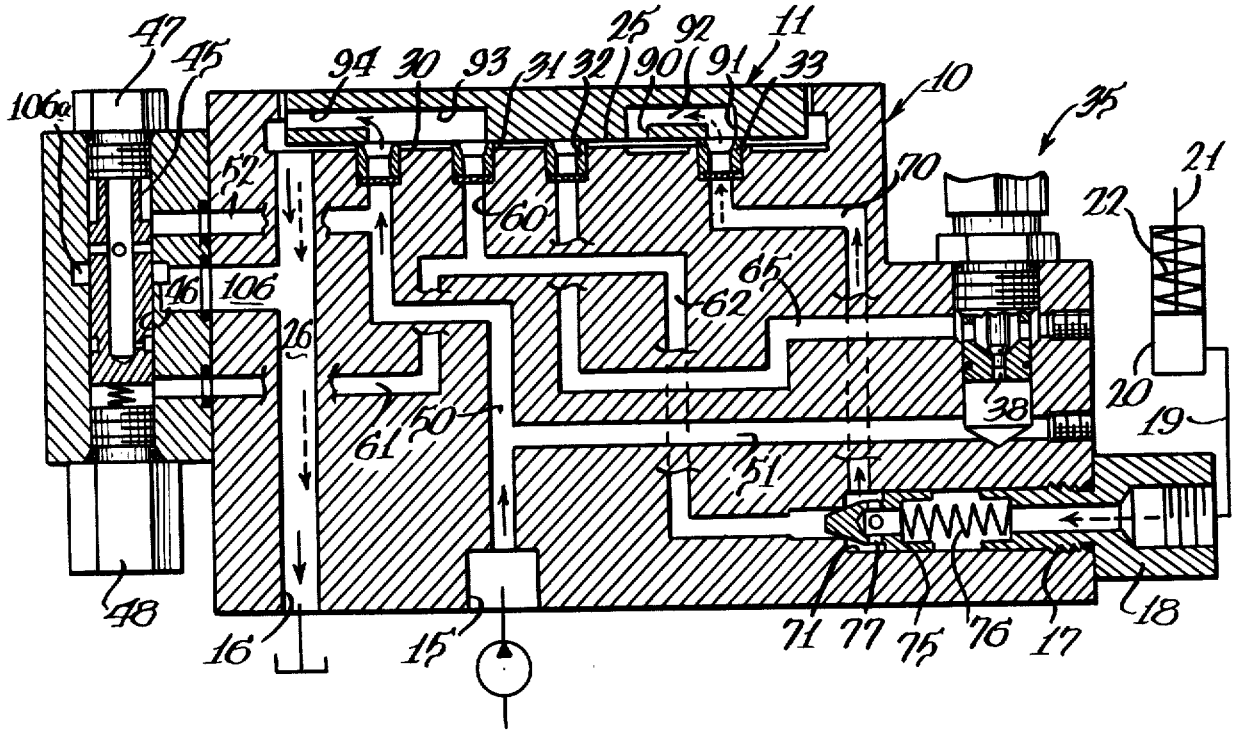
FIG. 8 is a diagrammatic vertical sectional view through the centers of the control ports and with the control ports of the control valve laid out in a direction looking from left to right in FIG. 7 and showing the control valve connected to a single-acting cylinder for the return mode of operation.

The valve components are positioned in FIGS. 1 and 2 to provide a return operation and which is shown diagrammatically in FIGS. 7 and 8. Referring to the latter Figures, the valve body 10 has a pressure port 15 connected to a source of fluid under supply pressure, such as a high pressure pump. A tank port 16 provides for return of fluid to a reservoir and an outlet port 17 has a fitting 18 connectable through a line 19 to a linear motor, such as a single-acting cylinder 20 having a piston rod 21 and a return spring 22. In the return position of the control valve, fluid is free to flow to the reservoir through the tank port 16 by urging of the spring 22 in the cylinder, as well as by gravity if the cylinder is appropriately disposed for such action.

The valve member 11 has a lower face spaced from a generally circular face 25 of the valve body and a tank passage 26 extends from the tank port to the outer periphery of the valve body face 25. Four control ports open to the valve body face 25 and are disposed on a generally circular orientation about the axis of rotation of the valve member as seen in FIGS. 1 and 7. Each of the control ports has a seat seal therein extending outwardly of the body face and engageable against the lower face of the valve member. A seat seal 30 is positioned within the first control port. A seat seal 31 is positioned within the second control port. A seat seal 32 is positioned in the third control port and a seat seal 33 is positioned in the fourth control port. The seat seals are of a type shown and particularly described in McClocklin U.S. Pat. No. Re. 30,517. The seat seals are constructed with opposed surfaces having a differential area whereby a resultant force resulting from fluid pressure urges the seat seals toward the valve member 11, with a force sufficient to maintain a seal, but still holding the frictional force to a minimum whereby the valve member may be rotated by the handle 12 with reasonable force.

As shown in FIG. 2 with respect to seat seal 32, each of the seat seals has an external annular groove with a sealing 0-ring 34 and an annular wave spring 34*a* urging the seat seal toward the valve member 11.

The control valve has a pressure-compensated flow control including an adjustable orifice device, indicated generally at 35, having a body 36 threaded into an opening in the valve body 10, as indicated at 37. The orifice device has an orifice opening 38 the size of which is controlled by a member 39 adjustably positioned within the opening to control the orifice size and, therefore, the rate of fluid flow to the motor when operating in metered advance operation. The adjustable orifice device 35 is a commercially available structure and includes a knob 40 rotatable to control the position of the member 39 within the opening 38 and has structure to lock the member 39 in a set position. The pressure-compensated flow control additionally includes a flow control spool 45 movable within a bore 46 formed in a separate connected part 10*a* of the body 10. As shown particularly in FIGS. 1 and 8, the bore 46 is closed off by a pair of threaded plug members 47 and 48, with the latter member partially housing a spring 49 which engages a pressure-sensing end of the spool 45 and urges the spool upwardly, as viewed in the Figures. The adjustable orifice device 35 and flow control spool 45 are associated with passage means in the body, to be described.

Figure 5:
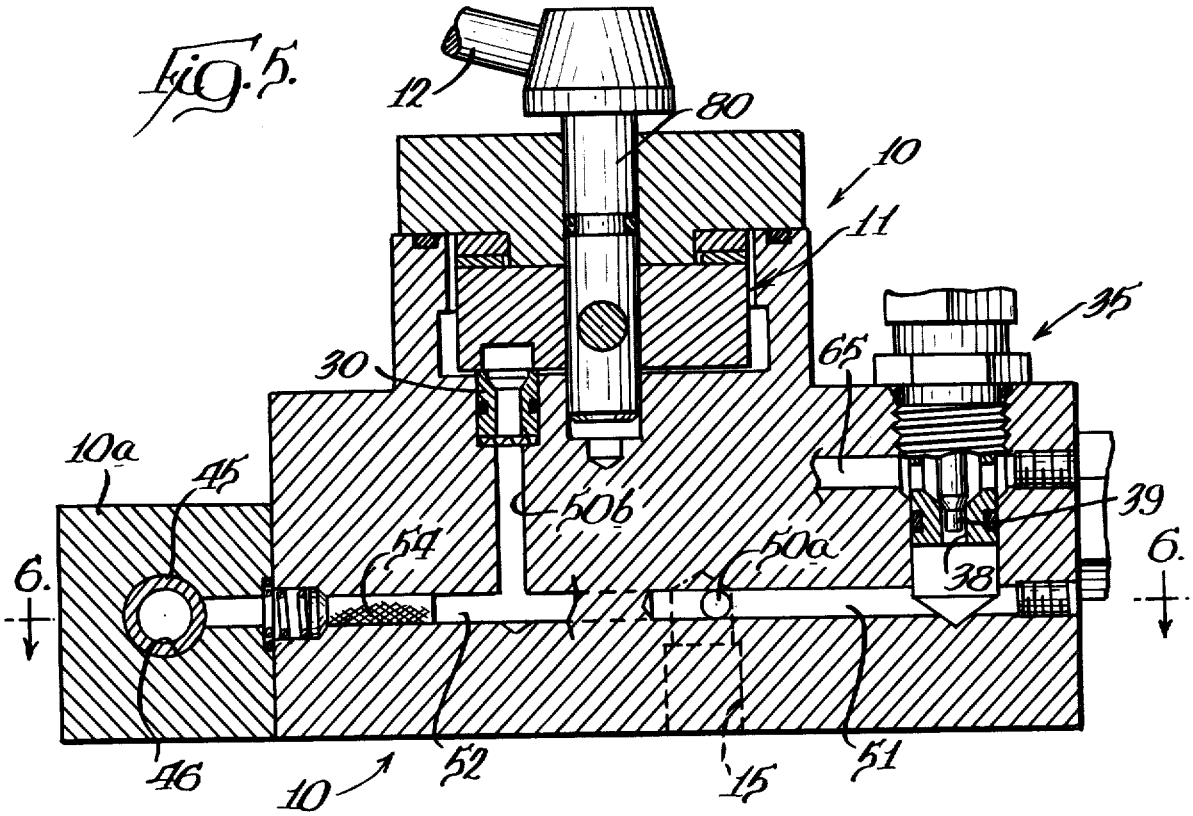
FIG. 5 is a vertical section, taken generally along the line 5—5 in FIG. 6.
Figure 6:
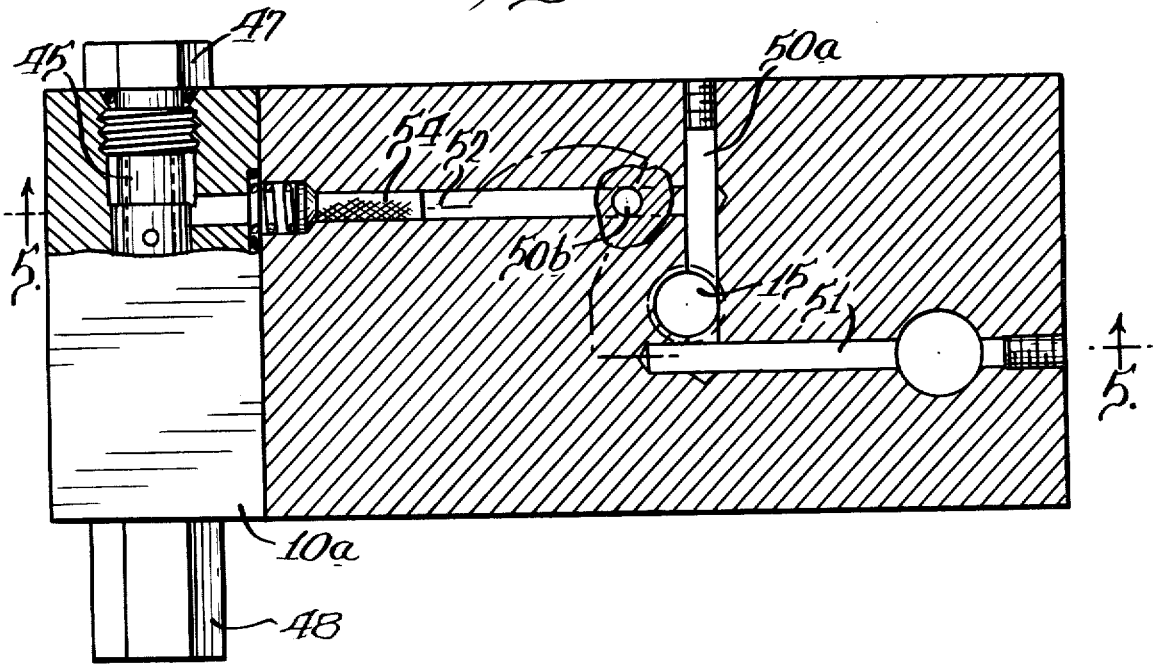
FIG. 6 is a plan section, taken generally along the line 6—6 in FIG. 5.

First passage means in the body 10 extends between the pressure port 15 and the first control port having the seat seal 30 by a passage 50, shown diagrammatically in FIG. 8, to the upstream end of the adjustable orifice device 35 by a passage 51, and to the pressure-regulating end of the flow control spool 45 by a passage 52. As seen in the structural sections of FIGS. 5 and 6, passage 50 has a horizontal passage section 50*a* extending from the pressure port 15 to connect with the horizontal passage 52 and an upwardly-extending passage section 50*b* effectively completes the passage 50, shown diagrammatically in FIG. 8 and connects to the first control port having the seat seal 30. The passage 52 has a filter 54 positioned therein.

Figure 3:
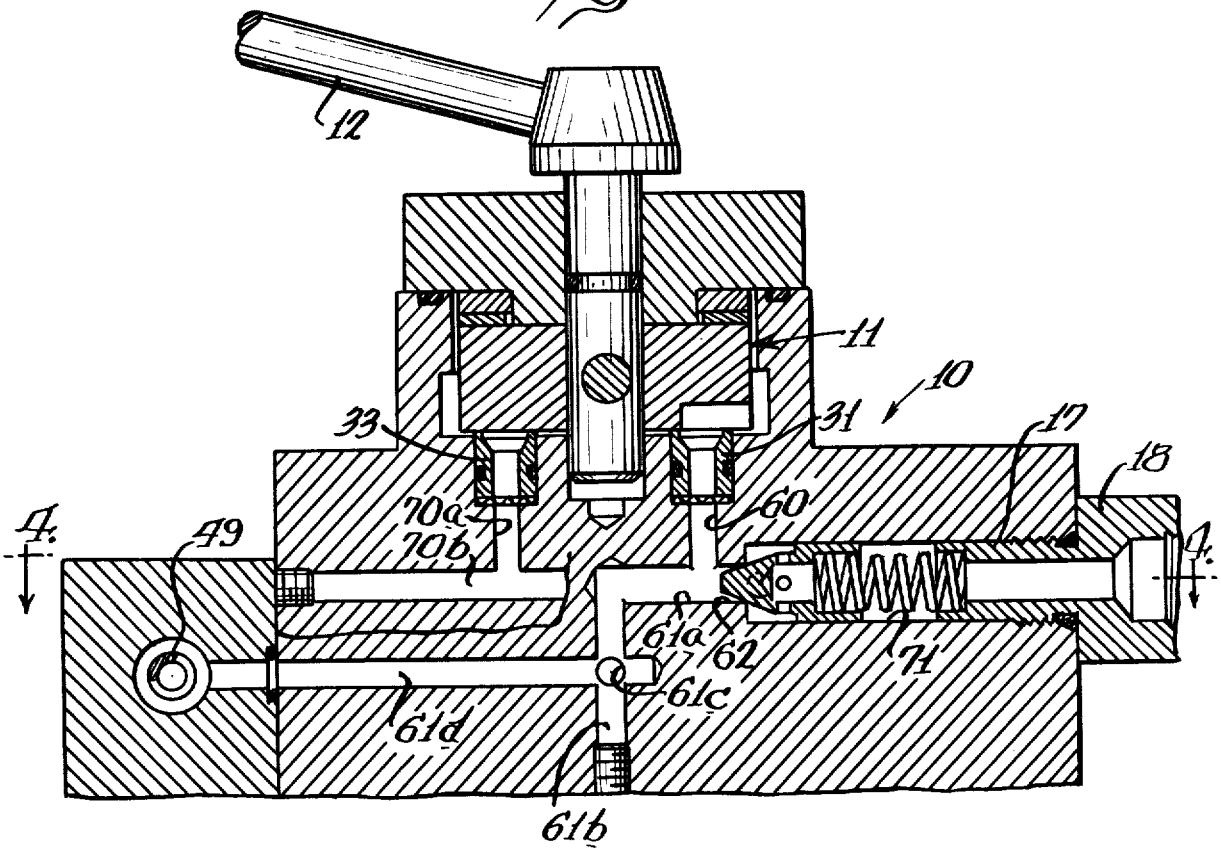
FIG. 3 is a vertical section, through the control valve, taken generally along the line 3—3 in FIG. 4.
Figure 4:
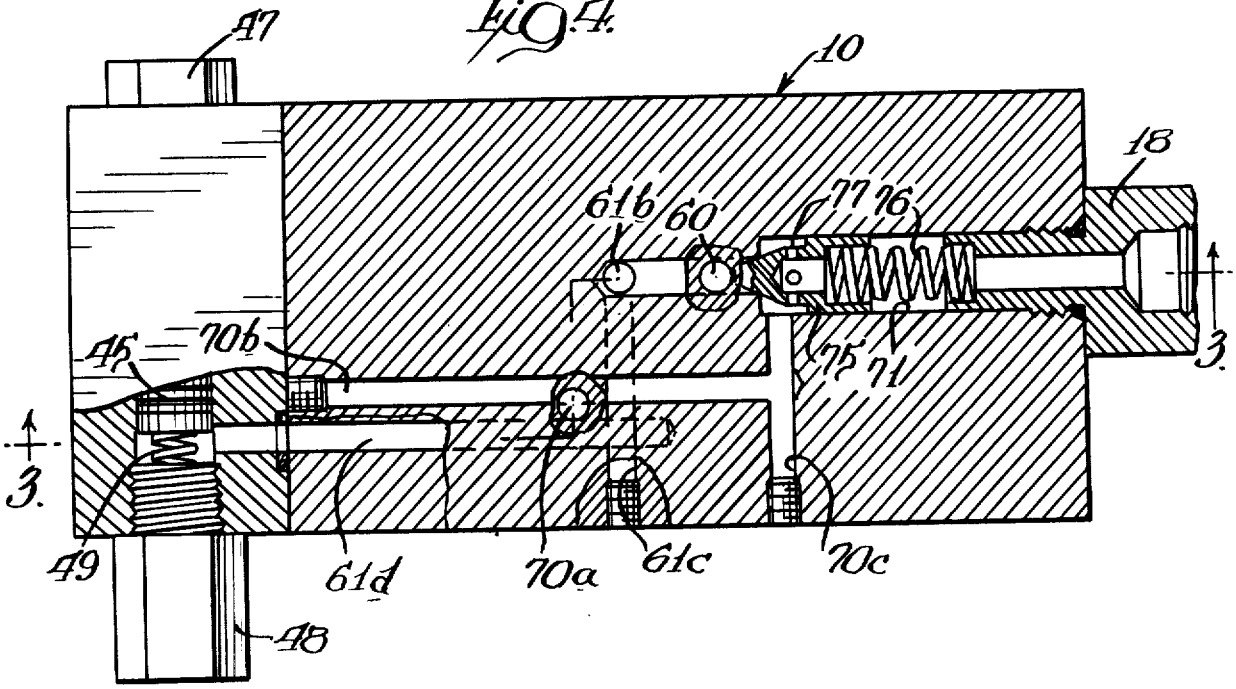
FIG. 4 is a plan section, taken generally along the line 4—4 in FIG. 3.

Second passage means in the valve body extends between a second of the control ports having the seat seal 31, the outlet port 17, and the pressure-sensing end of the flow control spool 45 adjacent the spring 49. This second passage means in the diagrammatic view of FIG. 8 includes passage 60 extending downwardly from the second control port and communicating with a passage 61 leading to the pressure-sensing end of the flow control spool 45 and a passage 62 leading to the outlet port 17. Referring to the structural views of FIGS. 3 and 4, passage 60 is seen to be located closely adjacent the outlet port 17 so that, in the actual construction, the passage 62 has a minimal length, while the passage 61 has passage sections 61*a* and 61*b* in a first vertical plane, with the passage section 61*b* intersecting a forwardly-extending plugged passage section 61*c* which intersects with a passage section 61*d* leading to the pressure-sensing end of the flow control spool.

Third passage means in the valve body extends between a third control port and the downstream end of the adjustable orifice device. More particularly, referring to the diagrammatic view of FIG. 8, the third control port having seat seal 32 connects to the downstream end of the adjustable orifice device 35 through a passage 65 and which is also shown in the structural views of FIGS. 2 and 5.

Fourth passage means in the valve body extends between the fourth control port and the outlet port. This passage means comprises a passage 70, shown in the diagrammatic view of FIG. 8, extending between the seat seal 33 in the fourth control port and a chamber 71 in the valve body at the outlet port 17. In the structural views of FIGS. 3 and 4, the passage 70 has a downwardly-extending passage section 70*a* extending from the seat seal 33 which intersects a laterally-extending passage section 70*b* which intersects a horizontal passage section 70*c* extending to the chamber 71.

The chamber 71 in the valve body mounts a check valve for preventing flow from the single-acting cylinder 20 to the passage section 62 of the second passage means. The check valve includes a check valve member 75 urged against a seat at the end of the passage section 62 by means of a spring 76 seated within the fitting 18 threaded into the outlet port 17. The check valve member has a hollow interior with radial passages 77 through the wall thereof whereby, when the check valve blocks the passage 62, there can still be communication between the outlet port and the passage 70 extending to the fourth control port.

The valve member 11 is mounted within the valve body 10 in the same general manner as shown in the aforesaid McClocklin U.S. Pat. No. Re. 30,517 by mounting on an operating shaft 80 rotatably mounted in the valve body and having the control handle 12 extending from one end thereof. The operating shaft 80 extends through an opening in the valve member 11 and the parts are connected for rotation together by means of a pin 81 extended through an opening in the operating shaft and into a transverse bore in the valve member at opposite sides of the operating shaft. A spring-urged ball detent 82 is mounted within the upper part of the valve body and positioned for engagement with one or more notches formed in the upper surface of the valve member to hold the valve member in selected positions. In the preferred embodiment, there are two notches positioned in the upper face of the valve member to coact with the spring-urged ball detent to hold the valve member in either of the positions for hold and metered advance. A pin 83 extends downwardly from the upper part of the valve body and loosely engages within a curved groove formed in the upper part of the valve member to limit the arc of rotation of the valve member.

The valve member 11 has means defining two different flow paths therethrough. Referring to FIGS. 7 and 8, a first flow path is defined by spaced-apart entry and exit ports 90 and 91 which are connected by an internal connecting bore 92 which is of a length to permit said one flow path to interconnect control ports in certain positions of the valve member. The second flow path of the valve member is of a length to span two control ports, as provided by a length 93 thereof and, as shown, the length 93 of the flow path opens to the face of the valve member and has a connecting section 94 to the periphery thereof.

The return mode of operation has the control handle 12 positioned, as shown in FIGS. 1, 2 and 7, to provide an operation wherein the fluid can flow from the single-acting cylinder 20 to the tank port 16. This operation is shown diagrammatically in FIG. 8, wherein the first through fourth control ports extend from left to right in the Figure, sequentially, and which, therefore is a diagrammatic view looking from left to right in FIG. 7, wherein the first through fourth control ports extend sequentially in a clockwise direction.

In the return operation, the valve member second flow path having the section 93 spans the first and second control ports whereby the section 94 thereof causes both of these control ports to be connected to reservoir through the tank port 16 by way of tank passage 26. The first flow path has the port 91 thereof overlying the seat seal 33 at the fourth control port and the other port 90 not overlying any control port, but opening downwardly to a space between the faces of the valve body and the valve member whereby fluid flowing to the fourth control port can reach the tank passage 26. The fluid reaches the fourth control port through the radial passages 77 of the check valve member 75 and with the check valve member blocking any flow to the passage 62 which leads to the second control port. This flow is shown in FIG. 8 wherein solid arrows illustrate the flow from the inlet port 15 to the tank port and the broken line arrows illustrate the flow from the single-acting cylinder to the tank port.

The rapid advance operation is diagrammatically illustrated in FIGS. 13 and 14 wherein the control handle 12 has been rotated something less than 180° from the return operation position, previously described in connection with FIGS. 7 and 8. In this position, the first flow path in the valve member 11 interconnects the first control port having the seat seal 30 with the second control port having the seat seal 31. This is shown in FIG. 14 wherein the port 90 overlies the seat seal 30 and the port 91 overlies the seat seal 31. This causes flow to the single-acting cylinder 20 by a flow path illustrated by the arrows wherein flow from the inlet port 15 flows through the passage 50 to the first control port and through the first flow path of the valve member 11 to the second control port. The fluid then flows through the passages 60 and 62 to the chamber 71 and unseats the check valve whereby fluid can flow through the radial passages 77 of the check valve member and through the outlet fitting 18 to the cylinder to cause extension of the piston rod. In this position of the valve member 11, the third and fourth control ports are inoperative, with the seat seals thereof engaged against the face of the valve member and the second flow path of the valve member in an effectively inoperative position.

Figure 11:
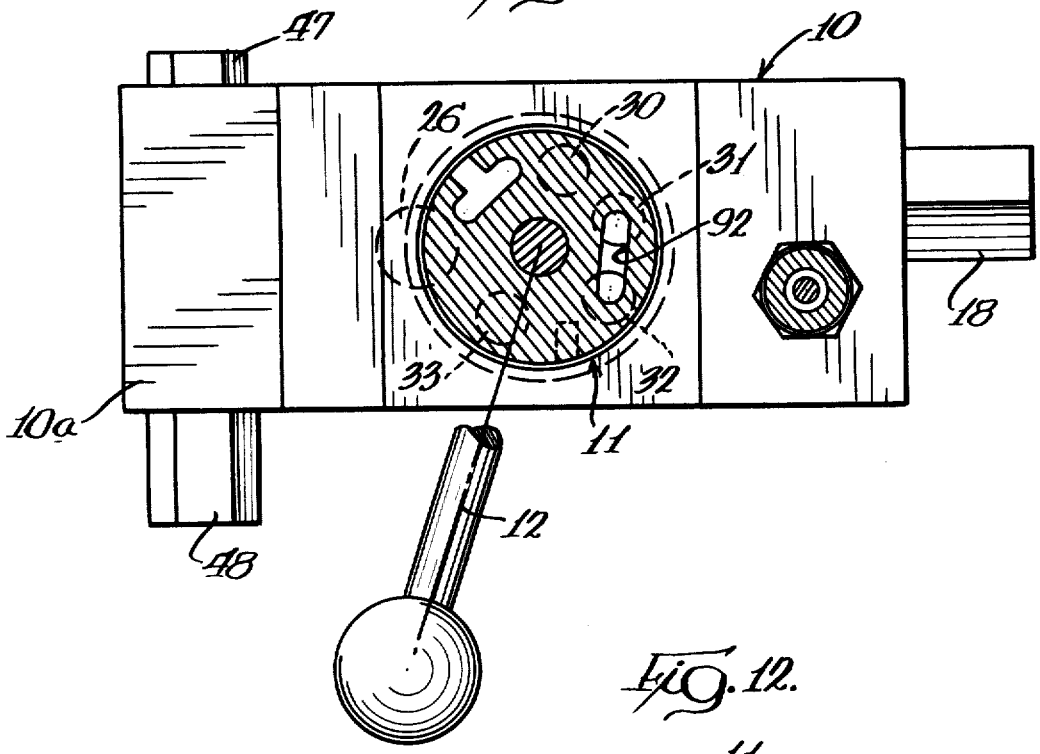
FIG. 11 is a view, similar to FIG. 7, showing the valve member positioned for a slow metered advance operation.
Figure 12:
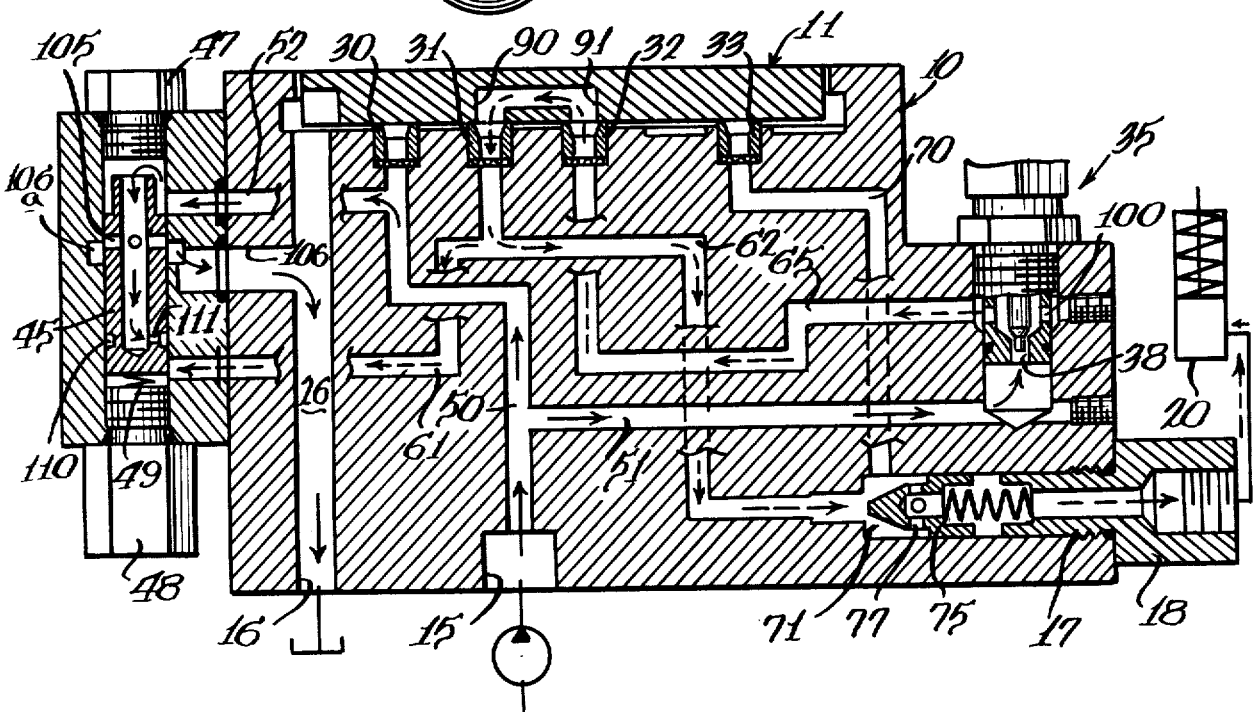
FIG. 12 is a view, similar to FIG. 8, showing the operative connections for the metered advance operation.
Figure 13:
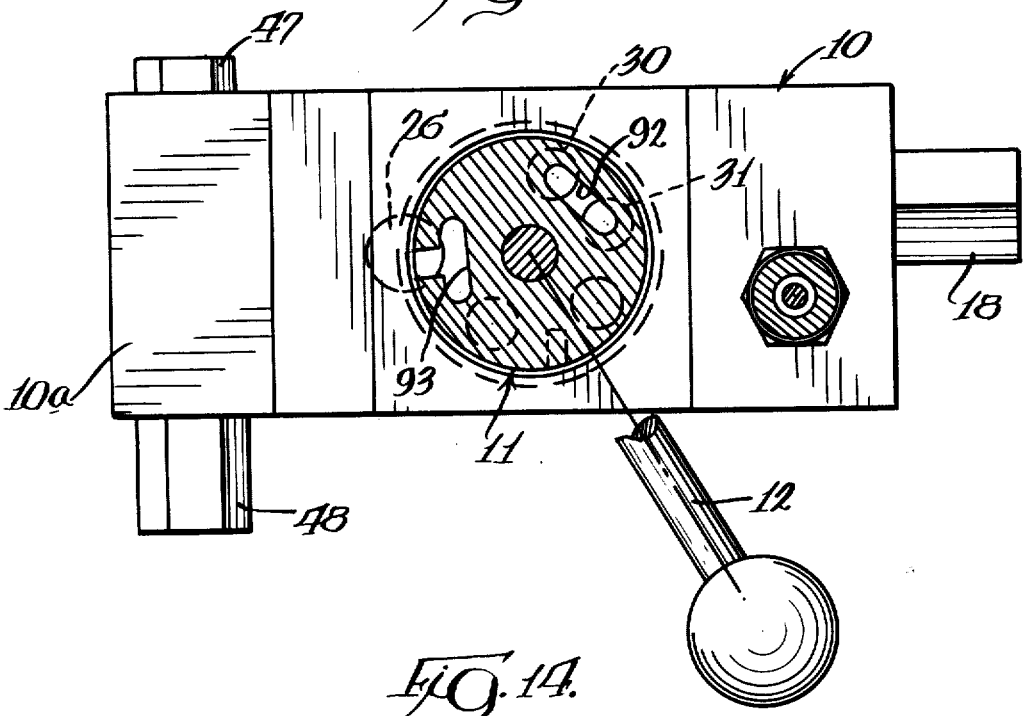
FIG. 13 is a view, similar to FIG. 7, showing the valve member positioned for full advance operation.
Figure 14:
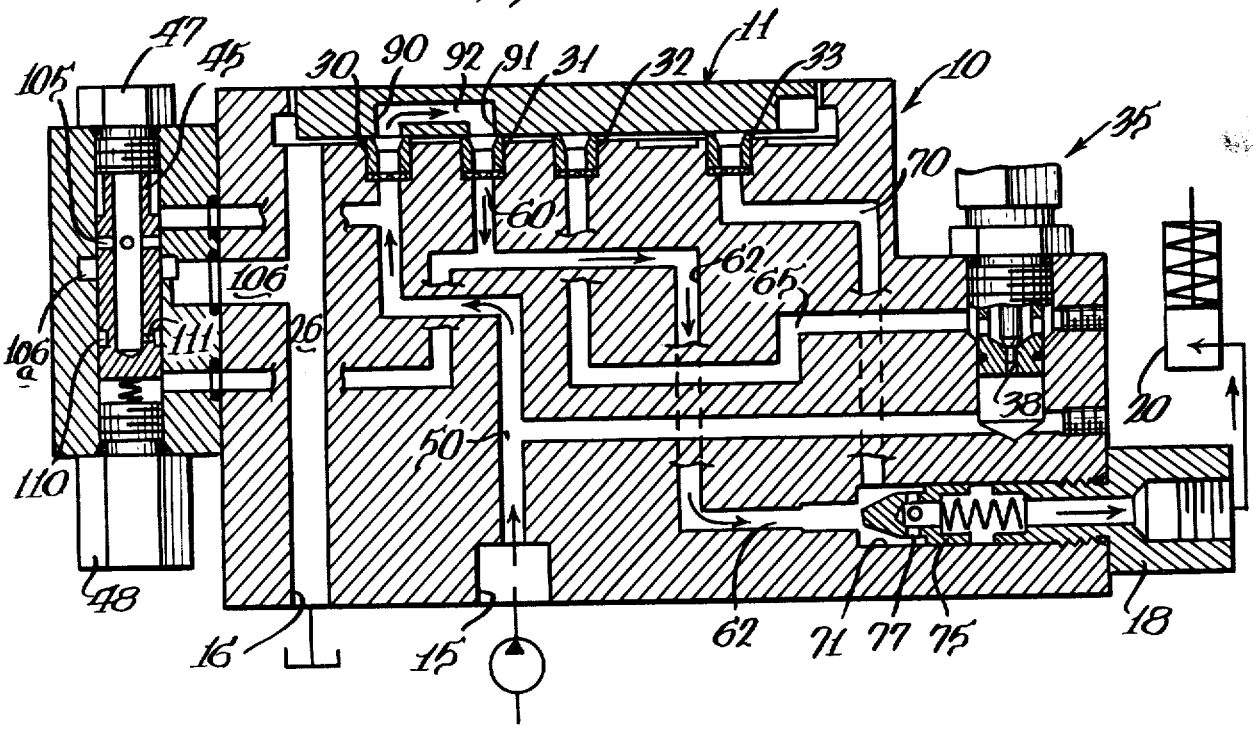
FIG. 14 is a view, similar to FIG. 8, showing the operative connections between the components for the advance operation.

When it is desired to have a slow, metered advance of the single-acting cylinder 20 and at a rate as established by the position of the control knob 40 of the adjustable orifice device 35, the control handle 12 is moved from the position of FIG. 13 to the position of FIG. 11 for positioning of the valve member 11, as shown in FIG. 11. In this position of the valve member 11, the second and third control ports are interconnected by the first flow path of the valve member for subjecting the fluid delivered to the single-acting cylinder to a pressure-compensated flow control action. In the position shown in FIGS. 11 and 12, the ports 90 and 91 of the first flow path overlie the seat seal members 31 and 32. In this position, the first and fourth control ports having the seat seals 30 and 33, respectively, are blocked.

Fluid entering the inlet port 15 flows through the passage 51 of the first passage means to the upstream end of the adjustable orifice device 35 and flows through the orifice opening 38 to the passage 65 of the third passage means through openings 100 in the wall of the adjustable orifice device. The fluid in the passage 65 extends to the pressure-sensing side of the flow control spool 45 through the passage 61 in the first flow path of the valve member which interconnects the second and third control ports. The flow through the second control port also passes through the passage 62 of the second passage means to the chamber 71 and unseats the check valve member 75 whereby fluid flows to the single-acting cylinder 20.

The adjustable orifice device sets a pressure drop across the orifice and the flow control spool 45 functions to maintain this pressure drop constant. The passage 52 of the first passage means directs fluid under supply pressure to the pressure-regulating end of the valve spool 45 wherein the fluid can flow into the hollow interior of the spool. Metering passages 105 extending through the wall of the spool coact with an edge of an annular groove 106*a* which communicates with a passage 106 connected to the tank passage 26 to control the bypass of fluid from the inlet port to the tank port. The flow control spool 45 functions to maintain supply pressure delivered at inlet port 15 at a pressure higher than that supplied to the single-acting cylinder by an amount caused by the force of the spring 49 urging the spool upwardly, as viewed in FIG. 12.

For improved operation in controlling the rate of flow to the single-acting cylinder, the flow control spool is provided with an external annular groove 110 which communicates with the interior of the spool through radial passage 111. Fluid at supply pressure is delivered to the external annular groove to form a block against metered flow delivered to the pressure-sensing end of the spool from leaking to the passage 106 leading to the tank passage 26.

Figure 9:
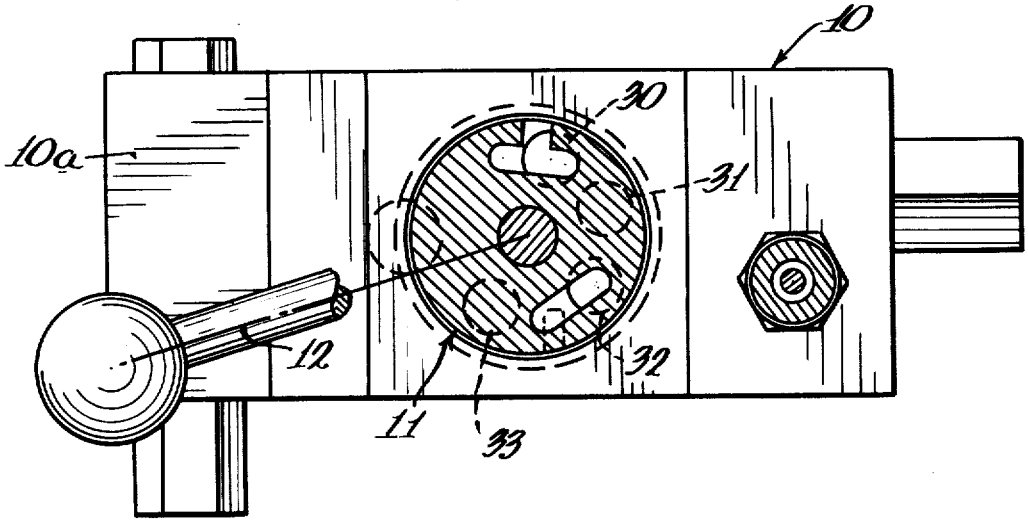
FIG. 9 is a view, similar to FIG. 7, showing the valve member positioned for a hold operation.
Figure 10:
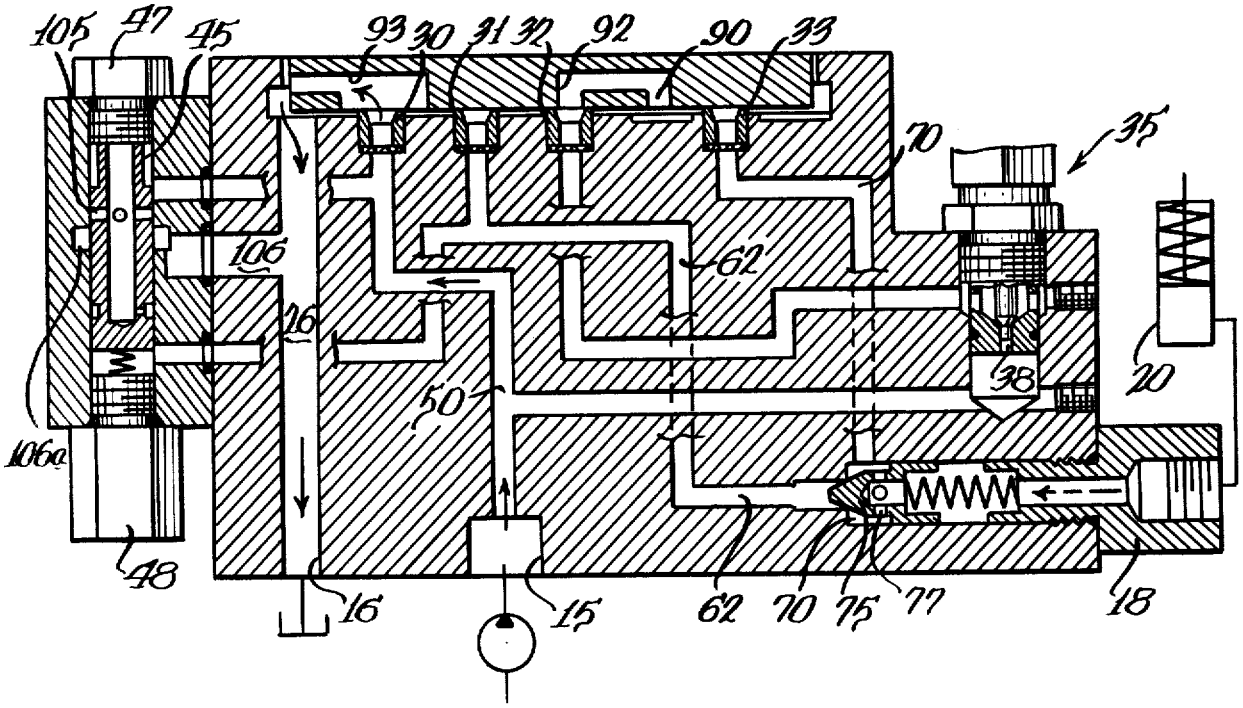
FIG. 10 is a view, similar to FIG. 8, illustrating the operative connections in the hold mode of operation shown in FIG. 9.

The control valve has a hold position, shown diagrammatically in FIGS. 9 and 10, wherein the control handle has been moved clockwise from the position shown in FIG. 11. In this position, the single-acting cylinder does not communicate with either the inlet port 15 or the tank port 16. The valve member 11 is positioned to block the second and fourth control ports having the seat seals 31 and 33. The first control port having the seat seal 30 is connected to the tank passage 26 by the second flow path in the valve member. The third control port having the seat seal 32 has the port 92 of the first flow path of the valve member communicating therewith and with the other port 90 thereof merely opening to the space between the face of the valve member and the valve body. As seen in FIG. 10, fluid cannot reach the passage 62 of the second passage means because of the check valve member 75 being on its valve seat and, although fluid can flow through the radial passages 77 of the check valve member, there is no such flow since the passage 70 of the fourth passage means extended to the fourth control port is blocked.

With the control valve structure disclosed herein, it is possible to control direction and speed of movement of the single-acting cylinder as well as to provide for hold positioning thereof by operation of a single handle. Fast return of the single-acting cylinder occurs because of the large opening in a seat seal providing a large flow passage. There is not any interflow as the valve member 11 is shifted between advance, metered advance, and hold positions because the seat seal 33 remains blocked by the valve member during such movements of the valve member and, therefore, no drop in pressure in the motor. Additionally, the operation in metered advance is improved by the construction of the flow control spool which prevents leakage of metered flow to tank.

We claim:

1. A rotary control valve comprising: a body having a pressure port, a tank port and an outlet port connectable to a single-acting cylinder; a valve member rotatable relative to and spaced from a face of the body; a tank passage extending from the periphery of said face to the tank port; four control ports opening to said body face and each having a seat seal extending outwardly of the body face and engageable against a face of the valve member; a pressure-compensated flow control associated with said body including an adjustable orifice device and a flow control spool; first passage means in said body extending to a first of said control ports, the upstream end of the adjustable orifice device, the pressure port and the pressure-regulating end of the flow control spool; second passage means in said body extending between a second of the control ports, the outlet port and the pressure-sensing end of the flow control spool; third passage means in said body extending between a third of said control ports and the downstream end of the adjustable orifice device; fourth passage means in said body extending between a fourth of the control ports and said outlet port; a check valve in said outlet port operable to prevent flow from the motor flowing to said second control port through said second passage means; and said valve member having means defining a pair of flow paths with a first flow path interconnecting said first and second control ports for rapid advance operation in a first position of the valve member; a second position of the valve member interconnecting said second and third control ports by said first flow path for subjecting fluid to a pressure-compensated flow control action for metered advance operation, said valve member having a third position wherein both flow paths thereof are operative to connect said first and fourth control ports to the tank passage for a return operation, and said valve member having a fourth position wherein said first control port is connected to the tank passage and said fourth control port is blocked for a hold operation.

2. A rotary control valve as defined in claim 1 wherein said flow control spool is movable within a bore in the body and has an annular external groove adjacent the pressure-sensing end of the spool, and passage means in said flow control spool for delivering pressure fluid from said first passage means to said annular external groove to block the leakage of fluid from the pressure-sensing end of the spool along the exterior surface of the spool.

3. A rotary control valve as defined in claim 1 wherein the means defining the flow paths in the valve member comprise, for one flow path, spacedapart entry and exit ports and an internal connecting bore of a length to permit said one flow path to interconnect control ports in the first and second positions of the valve member, and the other flow path being of a length to span two control ports and opening to the face of the valve member and also to the periphery thereof.

4. A four-position rotary control valve comprising: a body having a pressure port, a tank port and an outlet port connectable to a single-acting cylinder; a valve member rotatable relative to and spaced from a face of the body; four control ports in said body opening to said body face and each having a seat seal extending from the body face and engageable against a face of the valve member; a pressure-compensated flow control associated with said body including an adjustable orifice device and a flow control spool; first passage means in said body extending to a first of said control ports, the upstream end of the adjustable orifice device and the pressure-regulating end of the flow control spool; second passage means in said body extending between a second of the control ports, the outlet port and the pressure-sensing end of the flow control spool; third passage means in said body extending between a third of said control ports and the downstream end of the adjustable orifice device; fourth passage means in said body extending between a fourth of the control ports and said outlet port; a check valve operable to prevent flow from the motor to said second control port through said second passage means; and said valve member having means for interconnecting said first and second control ports for rapid advance operation in a first position of the valve member, for interconnecting said second and third control ports for subjecting fluid to a pressure-compensated flow control action for metered advance operation in a second position, for interconnecting said first and fourth control ports to the tank port for a return operation in a third position, and for connecting said first control port to the tank port and blocking said fourth control port in a fourth position.

5. A rotary control valve as defined in claim 4 wherein said flow control spool is movable within a bore in the body and has an annular external groove adjacent the pressure-sensing end of the spool to which inlet pressure fluid is directed for blocking fluid leakage from the pressure-sensing end of the spool.

6. A rotary control valve comprising: a body having a pressure port, a tank port and an outlet port connectable to a single-acting cylinder; a four-position valve member rotatable relative to and spaced from a face of the body; four control ports opening to said body face; a pressure-compensated flow control associated with said body including an orifice device and a flow control spool; first passage means in said body extending to a first of said control ports, the upstream end of the orifice device and the pressure-regulating end of the flow control spool; second passage means in said body extending between a second of the control ports, the outlet port and the pressure-sensing end of the flow control spool; third passage means in said body extending between a third of said control ports and the downstream end of the adjustable orifice device; fourth passage means in said body extending between a fourth of the control ports and said outlet port; and said valve member interconnecting said first and second control ports for rapid advance operation in a first position of the valve member, a second position of the valve member interconnecting said second and third control ports for subjecting fluid to a pressure-compensated flow control action for metered advance operation, said valve member having a third position operative to connect said first and fourth control ports to the tank port for a return operation, and said valve member having a fourth position wherein said first control port is connected to the tank port and said fourth control port is blocked.

7. A four-position rotary control valve comprising: a body having a pressure port, a tank port and an outlet port connectable to a single-acting cylinder; a valve member rotatable relative to and spaced from a face of the body; first, second, third, and fourth control ports in said body opening to said body face and each having a seat seal extending from the body face and engageable against a face of the valve member, said four control ports being positioned sequentially along a curved line at a distance from the axis of rotation of the valve member; a pressure-compensated flow control associated with said body; a check valve operable to prevent flow from the motor to said second control port; said valve member having means for interconnecting said first and second control ports for rapid advance operation while blocking the fourth control port in a first position of the valve member, for interconnecting said second and third control ports for subjecting fluid to a pressure-compensated flow control action for metered advance operation while blocking the fourth control port in a second position, for interconnecting said first and fourth control ports to the tank port for a return operation in a third position, and for connecting said first control port to the tank port and blocking said fourth control port in a fourth hold position; and said fourth control port being positioned to be covered by said valve member as the valve member moves between said first, second and fourth positions.

8. A four-position rotary control valve comprising: a body having a pressure port, a tank port and an outlet port connectable to a single-acting cylinder; a valve member rotatable relative to and spaced from a face of the body; four control ports in said body opening to said body face and each having a seat seal extending from the body face and engageable against a face of the valve member; a pressure-compensated flow control associated with said body including an adjustable orifice device and a flow control spool; first passage means extending to a first of said control ports; second passage means extending between a second of the control ports and the outlet port; third passage means extending between a third of said control ports and the adjustable orifice device; fourth passage means extending between a fourth of the control ports and said outlet port; a check valve operable to prevent flow from the motor to said second control port through said second passage means; said valve member having means for interconnecting said first and second control ports for rapid advance operation in a first position of the valve member, for interconnecting said second and third control ports for subjecting fluid to a pressure-compensated flow control action for metered advance operation in a second position, for interconnecting said first and fourth control ports to the tank port for a return operation in a third position, and for connecting said first control port to the tank port and blocking said fourth control port in a fourth hold position; and said valve member being constructed to continuously block said fourth control port as the valve member moves between said first, second and fourth positions.

9. A four-position rotary control valve comprising: a body having a pressure port, a tank port and an outlet port connectable to a single-acting cylinder; a valve member rotatable relative to and spaced from a face of the body; flow control means associated with said body; first, second, third, and fourth control ports in said body opening to said body face adjacent said valve member, said four control ports being positioned sequentially along a curved line at a distance from the axis of rotation of the valve member with the first control port connected to the pressure port, the second control port connected to said outlet port, the third control port being in fluid circuit with the flow control means and the fourth control port connected to said outlet port; means operable to prevent flow from the motor to said second control port; said valve member having means for interconnecting said first and second control ports to connect the pressure port to the outlet port for rapid advance operation while blocking the fourth control port in a first position of the valve member, for interconnecting said second and third control ports for subjecting fluid to flow control action for metered advance operation while blocking the fourth control port in a second position, for interconnecting said first and fourth control ports to the tank port for return operation in a third position, and for connecting said first control port to the tank port and blocking said fourth control port in a fourth hold position; and said fourth control port being positioned and the valve member constructed to have the fourth control port covered by said valve member as the valve member moves between said first, second and fourth positions.

10. A four-position rotary control valve comprising: a body having a pressure port, a tank port and an outlet port connectable to a single-acting cylinder; a valve member rotatable relative to and spaced from a face of the body; flow control means associated with said body; first, second, third, and fourth control ports in said body opening to said body face, said four control ports being positioned sequentially along a curved line at a distance from the axis of rotation of the valve member; means operable to prevent flow from the motor to said second control port; said valve member having means for interconnecting said first and second control ports to connect the pressure port to the outlet port for rapid advance operation while blocking the fourth control port in a first position of the valve member, for interconnecting said second and third control ports for subjecting fluid to flow control action for metered advance operation while blocking the fourth control port in a second position, for interconnecting said first and fourth control ports to the tank port for a return operation in a third position, and for connecting said first control port to the tank port and blocking said fourth control port in a fourth hold position.

11. A rotary control valve as defined in claim 10 wherein said flow control means includes a flow control spool movable within a bore in the body, said flow control spool having an annular external groove adjacent a pressure-sensing end thereof, and passage means in said flow control spool for delivering fluid under pressure to said annular external groove to block the leakage of fluid from the pressure-sensing end of the spool along the exterior surface of the spool.

* * * * *